United States Patent [19]

Jernstrom et al.

[11] 4,085,540

[45] Apr. 25, 1978

[54] MECHANICAL TOY ATHLETE

[76] Inventors: Hans Ebbe Ingevar Jernstrom, 279 B Rolling Wood L.B.S., Barrington, Ill. 60010; Thomas Lee Long, 2528 N. Walnut, Arlington Heights, both of Ill. 60004

[21] Appl. No.: 695,824

[22] Filed: Jun. 14, 1976

Related U.S. Application Data

[63] Continuation-in-part of Ser. No. 612,495, Sep. 11, 1975, abandoned.

[51] Int. Cl.[2] ..... A63H 13/04

[52] U.S. Cl. ..... 46/119; 125/5; 273/101; 46/128

[58] Field of Search ..... 46/119, 128, 142, 161, 46/151; 273/1.5 R, 101; 125/5

[56] References Cited

U.S. PATENT DOCUMENTS

| | | | |
|---|---|---|---|
| 2,249,670 | 7/1941 | Sidel | 46/128 |
| 2,506,190 | 5/1950 | Barnes | 46/128 |
| 3,009,267 | 11/1961 | Bezark | 46/151 |
| 3,425,153 | 2/1969 | Bonnano et al. | 46/119 |
| 3,758,982 | 9/1973 | Lemelson | 46/119 |

*Primary Examiner*—Louis G. Mancene
*Assistant Examiner*—Robert F. Cutting
*Attorney, Agent, or Firm*—Dorsey, Windhorst, Hannaford, Whitney & Halladay

[57] ABSTRACT

A mechanical toy athlete built on a base has a hollow body portion comprising the torso of the athlete. A slidable plunger extends from within and out the top of the hollow body portion. The head of the athlete mounts on the top end of the plunger. Downward external pressure on the head moves the plunger from a rest position into which it is biased. A lever arm which represents either an arm or leg of the athlete, depending on the sport that the athlete "plays," mounts to the hollow body portion. The lever arm rotates relative to the hollow body portion in a fashion resembling the movement of the human limb which the lever arm represents and the lever arm is also biased into a rest position. The plunger, as it moves from its rest position, cooperates with the lever arm to rotate the lever arm from its rest position. When the lever arm rotates from its rest position, it propels a toy projectile, which represents the object that the athlete uses in the sport he "plays." Particular embodiments of the toy athlete represent football, basketball, soccer and hockey players.

21 Claims, 20 Drawing Figures

MECHANICAL TOY ATHLETE

CROSS-REFERENCE TO RELATED APPLICATION

This application is a continuation-in-part of copending application Ser. No. 612,495 filed Sept. 11, 1975, now abandoned, and entitled Mechanical Toy Sports Figure.

BACKGROUND OF THE INVENTION

1. Field of the Invention

This invention relates generally to a mechanical toy and, more particularly, to a mechanical toy athlete.

2. Description of the Prior Art

Mechanical toys used as amusement or game apparatus are found in the prior art. Some of them perform the task of propelling a toy projectile or game piece; some resemble in shape and movement mechanical toy athletes. While several prior art structures of this general nature exist, each exhibits certain disadvantages.

One prior art structure is based on a spring-powered pivoting member for propelling the toy projectile, (e.g., Wale, U.S. Pat. No. 653,127; Marx, U.S. Pat. No. 1,516,023). In this structure, the pivoting member is drawn back against the tension of a spring means and then released, with the spring propelling the member toward the toy projectile to be struck. Since the striking force comes from the spring means, the amount of force available is limited by the spring and may be reduced as the spring fatiques. An additional disadvantage with this structure is that the lever mechanism used to place the spring under tension may have such a configuration that the realism of any toy athlete built with this structure would be affected.

Another prior art structure is based on a plunger and lever mounted in a tubular shaft and biased with a coil spring (e.g., Bodge, U.S. Pat. No. 2,106,625; Ogdon, U.S. Pat. No. 3,091,465). Force supplied through the plunger to one end of the lever member powers the other end. While in this structure the striking force is not limited by the strength of a spring, the tubular supporting structure offers little opportunity to make a realistic body for the toy athlete. In addition, the metal coil spring, which is used for biasing and which may break or fatique, is not easily replaced by the typical child user of such a toy.

A third structure found in the prior art uses a gravity-balanced pivoting member driven by pressure exerted on a cam surface located near the pivot point at the center of the member (e.g., Rigney, U.S. Pat. No. 905,586). While this third structure avoids some of the disadvantages of a spring-driven or spring-biased tubular structure, the gravity-balanced pivoting member is not suitable for producing a realistic toy athlete, since part of the balanced member might have to extend outside the body of the figure and could not be disquised as a limb.

A fourth structure known to the prior art is shown in Barnes, U.S. Pat. No. 2,506,190. The fourth structure is similar to the third in that it uses a gravity-balanced pivoting member, but it comes closer than the third structure to actually resembling a real human athlete. However, it is far less realistic than the patent drawings indicate. The intent is for the pivoting member to resemble the kicking leg of a football player and the drawings show the leg gravity-balanced in an upright position when it is at rest. But in reality, the location of the pivot point of the kicking leg will cause it to hang in a slightly forward position. Since a real football player would not stand with one leg partially extended into a kicking position, the fourth structure falls short of exhibiting the realism desired in such toys.

SUMMARY OF THE INVENTION

It is an object of the present invention to achieve simplicity, reliability, manufacturing economy, and realism in a toy athlete to a degree unknown in the prior art.

In accordance with that and other objects of the present invention, a mechanical toy comprises a hollow body portion resembling a human torso. A plunger is mounted within the hollow body portion and is slidable longitudinally from a rest position, into which it is biased, toward an extended position. A lever arm includes an axle member that is pivotally mounted in bearing means included in the hollow body portion. The lever arm resembles in appearance and movement a limb of the human figure. The lever arm cooperates with the plunger to rotate the lever arm from a rest position, into which it is biased, toward an extended position when the plunger is moved from its rest position toward its extended position by an externally supplied force.

BRIEF DESCRIPTION OF THE DRAWINGS

The present invention may be better understood by reference to the following detailed description in conjunction with the accompanying drawings, in all of which like numerals refer to like features, wherein.

DETAILED DESCRIPTION OF THE INVENTION

Figure 1:
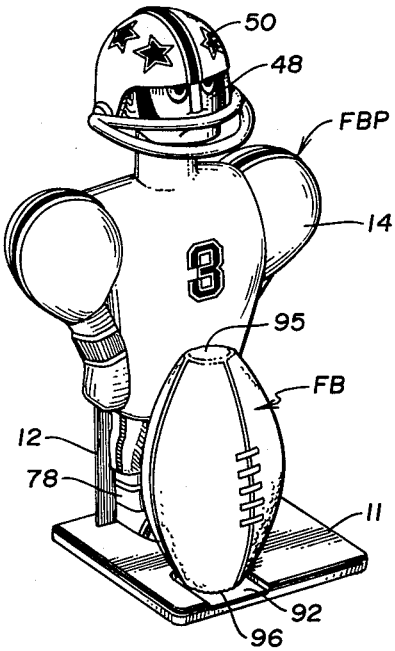
FIG. 1 is a pictorial drawing of a mechanical toy athlete showing the embodiment of the present invention in which the toy athlete represents a football player.

FIG. 1 shows a mechanical toy athlete FBP which, according to one embodiment of the present invention, represents a football player. The football player propels a toy projectile FB, which in the present embodiment resembles a toy football.

Figures 2, 4, 5, 6, 7:
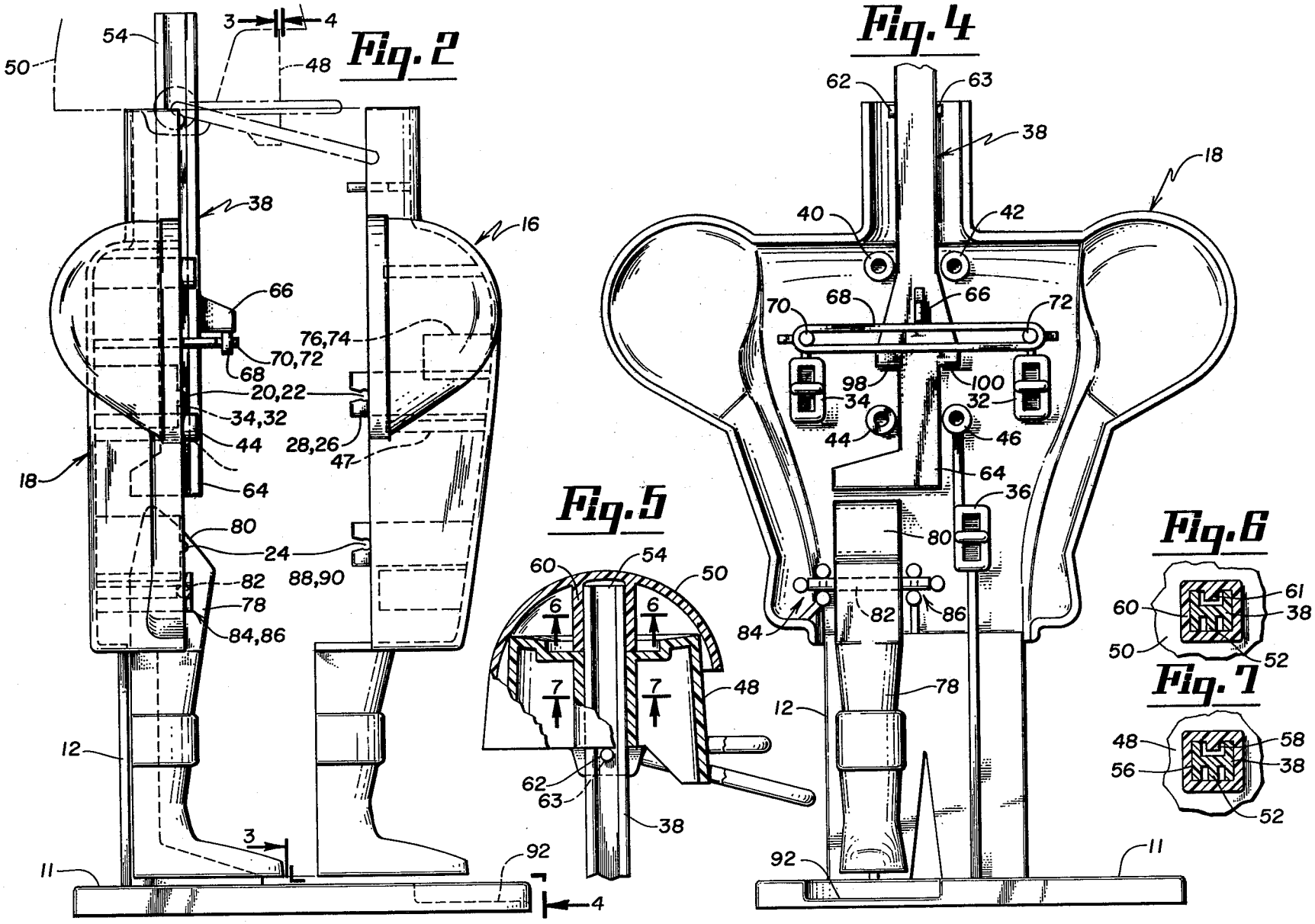
FIG. 2 is a right side elevation of the toy athlete shown in FIG. 1 showing the front and back halves of the athlete's torso separated.
FIG. 4 is a view of the interior of the back half of the torso taken along line 4—4 of FIG. 2.
FIG. 5 is a right side elevation of the head of the toy athlete shown in FIG. 1 with the parts broken away.
FIG. 6 is a section view of the head taken along line 6—6 of FIG. 5.
FIG. 7 is a section view of the head taken along line 7—7 of FIG. 5.
Figure 3:
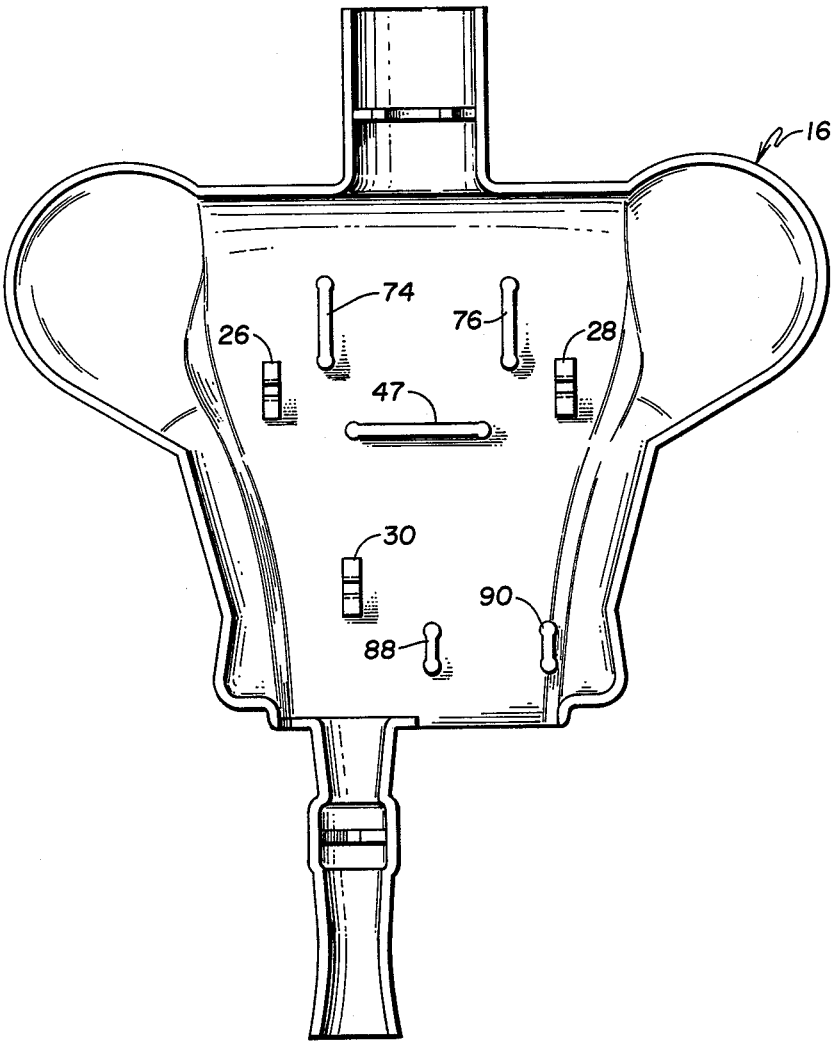
FIG. 3 is a view of the interior of the front half of the torso taken along line 3—3 of FIG. 2.

Referring now to FIGS. 2, 3, and 4, the mechanical toy athlete has a supporting structure including a base 11 and a vertical strut 12. The strut 12 secures a hollow body portion 14, shaped to resemble the padded torso of a football player, to the base 11. Markings resembling those of a football player are placed on the hollow body portion 14, for example, by painting or using decals, to increase realism. The hollow body portion 14 is formed by a front body piece 16 and a back body piece 18 which form the front and back halves, respectively, of the hollow body portion 14. The front body piece 16 also conveniently includes, as a single integral structure, the front part of the neck and stationary leg, in this case the left leg, of the toy athlete. The back body piece 18 includes his arms and the back half of his neck. In the embodiment shown, the back body piece 18, the base 11 and the vertical strut 12 conveniently form an integral structure, and the strut 12 comprises the back part of the legs of the toy athlete. While it would increase manufacturing cost, the strut 12 could be formed to more realistically resemble the back part of the figure's legs. The front body piece 16 and the back body piece 18 are secured to each other at three snap-in attachment points 20, 22, 24. Three male members 26, 28, 30 projecting from the front body piece 16 and three corresponding female members 32, 34, 36 on the back body piece 18, which cooperate with the male members 26, 28, and 30 respectively, form the snap-in attachment points.

The hollow body portion 14 encloses a slidable plunger 38, constrained laterally by four projections 40, 42, 44, and 46 (best seen in FIG. 4) from the back body piece 18 and one projection 47 (best seen in FIG. 3) from the front body piece 16. A head 48 and helmet 50 are attached at the top end 54 of the plunger 38.

FIGS. 5, 6, and 7 show keying means used to orient the head 48 and helmet 50 relative to the hollow body portion 14. The plunger 38 has an I-shaped cross section, which is supplemented by a filler flange 52 for a predetermined length proximate to the top end 54 of the plunger 38. The head 48 has a square opening 56 in its center just large enough to permit the plunger 38 to pass through the head 48. A keying flange 58 extends into the opening 56. The helment 50 has a blind squre opening 60 that is large enough to accept the top end 54 of the plunger 38 but is small enough to engage the plunger 38 frictionally. The keyed fit in the blind square opening 60 is accomplished by means of a keying flange 61 extending into the blind square opening 60. The filler flange 52 on the plunger 38, the keying flange 58 in the head 48, and the keying flange 61 in the helmet 50 cooperate so that the head 48 and the helmet 50 can only be fitted onto the top end 54 of the plunger 38 when the head 48 and helmet 50 are properly oriented toward the front of the figure. Projections 62, 63 on the plunger 38 form a stop means. The depth of the blind square opening 60 and the location of the projections 62, 63 enable the head 48 to be captured between the projections 62, 63 and the helmet 50. The head 48 and helmet 50 thus comprise a striker that will not rattle and that adds realism to the toy. Markings on the helmet 50 resembling markings on a real football player's helmet and markings on the head 48 resembling a human face add further realism. The markings can be provided either by painting or by using decals or in any other suitable manner.

Referring again to FIGS. 2, 3, and 4, the plunger 38 is substantially shaped like a reversed "L", having a horizontal member and a vertical member, when viewed from the front. The horizontal member is located at the bottom end 64 of the plunger 38. Between the top and bottom ends of the plunger 38 and within the hollow body portion 14 is an engaging means 66, here a small tab, which is adjacent to a spring means 68 for biasing the plunger into a rest position. The spring means in this embodiment is an elastic member 68 stretched between two fastening points, here projections 70, 72 from the back body piece 18, and further secured by other projections 74, 76 (best seen in FIG. 3) from the front body piece 16 when the front and back body pieces are assembled.

A lever arm 78, resembling in appearance a leg, here the right leg of the football player, has a cam surface 80 at one end and extends out of the hollow body portion 14. A pivot pin 82, horizontally oriented when the player is upright, forms an axle member for lever arm 78. Projections 84, 86 (best seen in FIG. 4) from the rear body piece 18 and projections 88, 90 (best seen in FIG. 3) from the front body piece 16 provide bearing means in which the pivot pin 82 is pivotally mounted. The lever arm 78 thus resembles in movement as well as appearance a leg of the football player. Realism is added by providing markings on the leg resembling those on a real football player.

Referring now again to FIG. 1, the base 11 contains holding means for removably holding the toy projectile FB. In the present embodiment, the holding means is an indentation 92 in the base 11, and the toy football has two flat ends 95, 96, which facilitate its standing upright in the indentation 92.

All of the parts of the toy athlete thus described, except for pin 82 and elastic band 68, are molded from plastic. However, those skilled in the art will recognize that other materials or methods of manufacture can be used without departing from the spirit of the invention.

Figure 8:
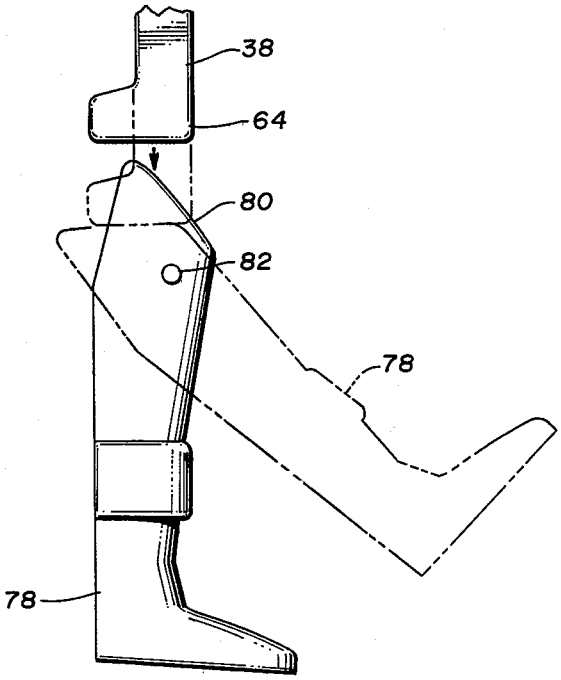
FIG. 8 is a right side elevation view showing in detail the operation of the embodiment of the plunger and lever arm of the present invention incorporated for illustrative purposes into the toy athlete shown in FIG. 1.

In operation, the plunger 38 is moved from its rest position (shown in solid lines in FIG. 8) toward its extended position (shown in dotted lines in FIG. 8) by a sharp, downwardly directed external force applied to the striker, which comprises the head 48 and the helmet 50. As the plunger 38 moves toward its extended position, the bottom end 64 of the plunger 38 cooperates with the cam surface 80. The lever arm 78 rotates around the pin 82 from its rest position (shwn in solid lines in FIG. 8) toward its extended position (shown in dotted lines in FIG. 8). The extended position of the plunger 38 is defined by two extended position limiting shoulders 98, 100 on each side of plunger 38 that cooperate with the projections 44, 46 which act as extended position limiting projections for the plunger. As best seen in FIG. 8, the shapes of the cam surface 80 and the bottom end 64 of the plunger 38 are such that the lever arm 78 swings rapidly upward toward its extended position, away from the base 11 and the support 12, and strikes the toy football, propelling it into the air. The cam surface 80 provides a mechanical advantage that gives the end of the lever arm 78 at which the player's foot is located sufficient velocity to propel the toy football a great distance.

As the plunger 38 is moved downward, toward its extended position, the small tab 66 engages the elastic member 68. When the downward external force is removed and the plunger 38 released, the elastic member 68 exerts a force upward against the small tab 66 which is sufficient to return the plunger 38 to its rest position. The lever arm 78 is biased into its rest position by gravity, and as the plunger 38 moves toward its rest position, the lever arm 78 falls back toward its rest position. The pivot pin 82 is located relative to the center of gravity of the lever arm 78 so that the lever arm 78 in its rest position is upright and therefore resembles the position in which a real football player would have his leg when he is at rest.

Figure 8B:
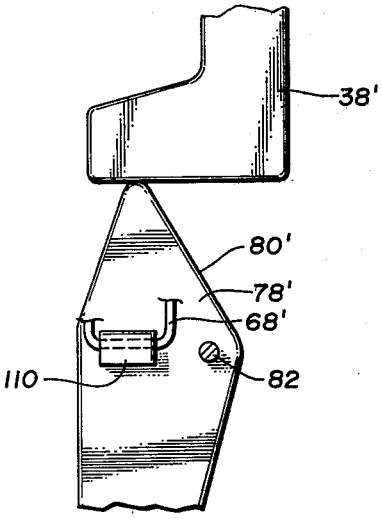
FIGS. 8A and 8B are front and side views, respectively, of an alternate embodiment of the present invention in which the plunger and lever arm shown in FIG. 8 are modified.
Figure 8A:
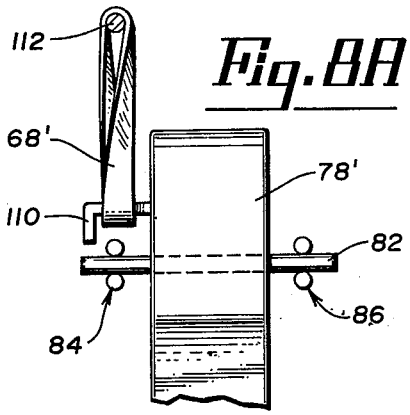

FIGS. 8A and 8B show an alternate embodiment of the present invention in which the plunger 38 and lever arm 78 described above are modified. In this embodiment, the tab 66 is omitted from the plunger 38', and projections 70, 72 are omitted from the back body piece. Instead, lever arm 78' includes a hook 110. An elastic band 68' loops over the hook 110 and over a projection 112 suitably secured to or molded into the back body piece.

In operation, the embodiment shown in FIGS. 8A and 8B is similar to the embodiment shown in FIGS. 1 through 7. However, in the embodiment shown in FIGS. 8A and 8B, the lever arm 78' is biased into its rest position by elastic band 68' rather than by gravity. The plunger 38' rests on the cam surface 80' on the lever arm 78' and is biased toward its rest position indirectly through lever arm 78'.

Figure 9:
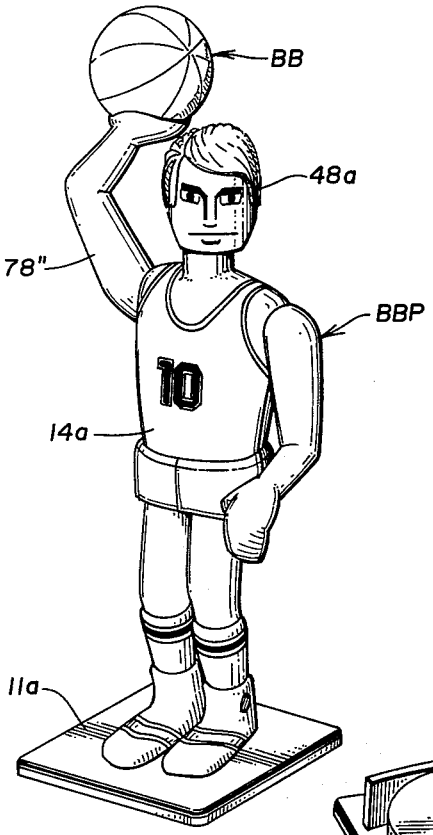
FIG. 9 is a pictorial drawing of a mechanical toy athlete showing the embodiment of the present invention in which the toy athlete represents a basketball player.

FIG. 9 is a pictorial drawing of a mechanical toy athlete BBP showing the embodiment of the present invention in which the athlete represents a basketball player. The basketball player includes a hollow body portion**14*a*** that is shaped to resemble a human basketball player and carries markings resembling those of the human basketball player. The basketball player propels a toy projectile BB, which in this embodiment represents a toy basketball.

Figure 10:
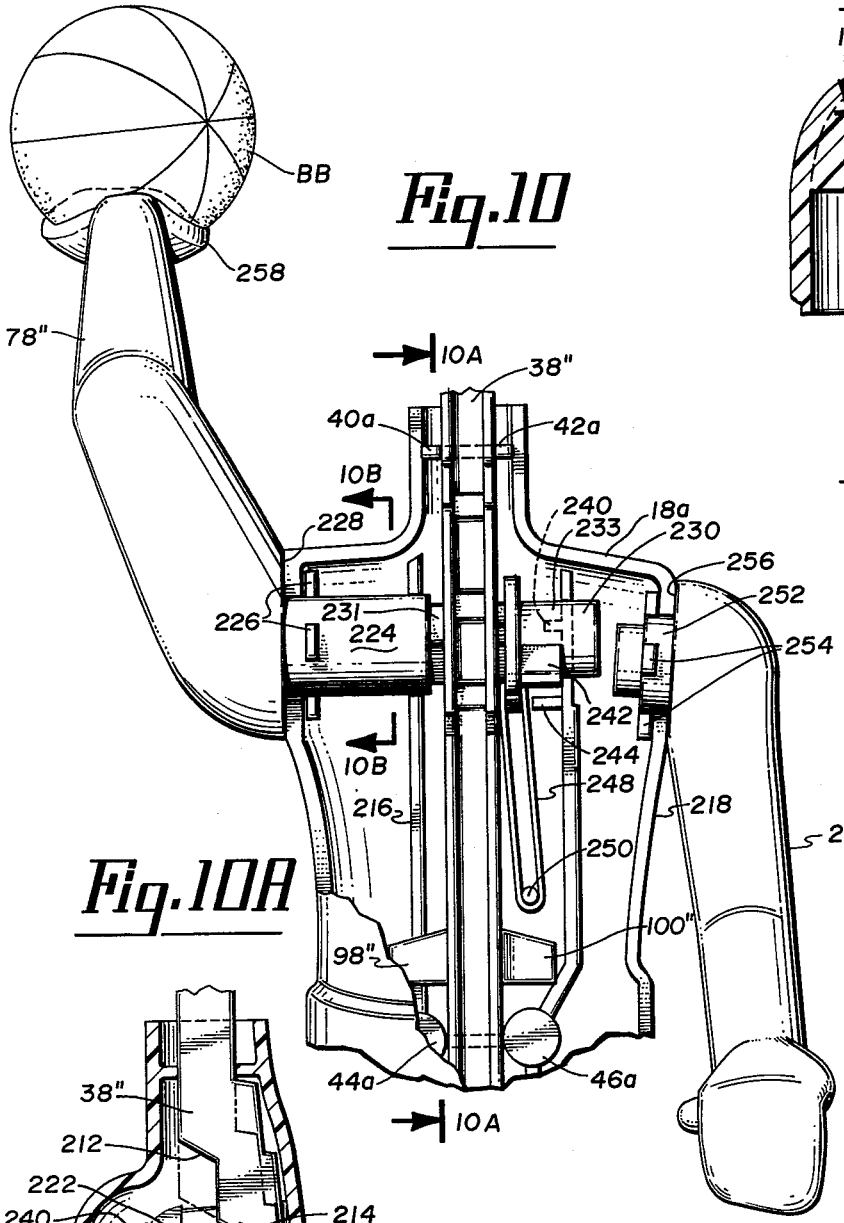
FIG. 10 is a view of the interior of the back half of the torso of the toy athlete shown in FIG. 9.

FIG. 10 shows the interior of the back body piece **18*a* of the toy basketball player. A description of the details of construction and assembly of the front body piece 16*a* and the back body piece 18*a* will be omitted here, except insofar as they differ from the previously described embodiment. Those skilled in the art will understand that those details are similar to the attachment points 20, 22 and 24** described in connection with the football player embodiment.

Figure 10A:
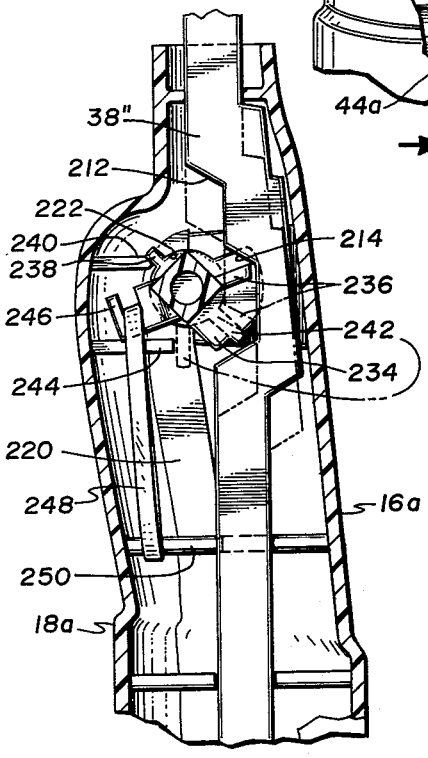
FIG. 10A is a section view taken along line 10A—10A of FIG. 10 showing in detail the operation of the embodiment of the plunger and lever arm of the present invention incorporated for illustrative purposes into the toy athlete shown in FIG. 9.
Figure 10B:
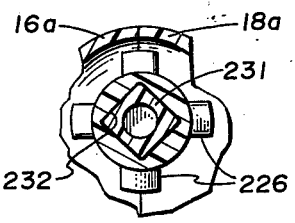
FIG. 10B is a section view taken along line 10B—10B of FIG. 10.

FIGS. 10, 10A and 10B show an alternate embodiment of the plunger and lever arm mechanism of the present invention, incorporated for illustrative purposes into the basketball player BBP. A slidable plunger 38'' is mounted for longitudinal movement in four projections **40*a*, 42*a*, 44*a*, and 46*a*. The plunger 38'' has two offsets, 212 and 214. Two protrusions 98'' and 100'' on the plunger 38'' and the projections 44*a* and 46*a* from the back body piece 18*a* limit the downward movement of the plunger 38' to define the extended position of the plunger 38'**.

The back body piece **18*a* includes bearing means for mounting the lever arm 78'' for rotation. The bearing means comprises two webs 216 and 218 that project into the interior of the hollow body portion 14*a* from back body piece 18*a* and two other webs, the only one shown being the web 220 (see FIG. 10A) that project into the interior of the hollow body portion 14*a* from the front body piece. The webs cooperate to form two aligned, circular cutouts, only one of which, the cutout 222, is shown (see FIG. 10A**).

The lever arm 78'' includes an axle member comprised of several parts. A hub 224 integral with the lever arm 78'' extends into the hollow body portion **14*a*. The hub 224 includes a segmented flange 226, which is spaced from a surface 228 of the lever arm 78'' to enable the lever arm 78'' to freely rotate relative to the hollow body portion 14*a*. The hub 224 rotates in one of the circular cutouts provided by the webs on the body pieces. A hub extension 230 has a portion 231 with a square cross section that fits within the hub 224 in a hole 232 having a square cross section formed in the hub 224 (see FIG. 10B). The hub extension 230 also includes a portion 233 having a round cross section that rotates in the cutout 222. A small tab 234 formed on the hub extension 230 cooperates with the web 218 to prevent the hub extension 230 from moving axially to the right (as seen in FIG. 10) when the athlete is assembled. The axle member is thus held in place axially by the tab 234, the flange 226 and the fact that the hub extension 230 is bottomed in the hole 232 in the hub 224**.

As seen in FIG. 10A, the hub extension 230 includes a radially extending finger 236 for cooperating with the surface formed by the offset 214 in the plunger 38''. The hub extension 230 further includes a rest position limiting finger 238 for cooperating with a rest position limiting tab 240 to limit rotation of the hub extension 230, and thereby limit the rotation of lever arm 78'' and define its rest position. The hub extension 230 also includes an extended position limiting finger 242 for cooperating with an extended position limiting tab 244 to limit rotation of the lever arm 78'' in the opposite direction and define its extended position. Finally, the hub extension 230 includes a radially extending protrusion 246 that has an elastic band 248 looped around it. The elastic band 248 is also looped around an anchor point 250 that is formed in the back body piece **18*a* and thereby biases the lever arm 78''** into its rest position.

Figure 11:
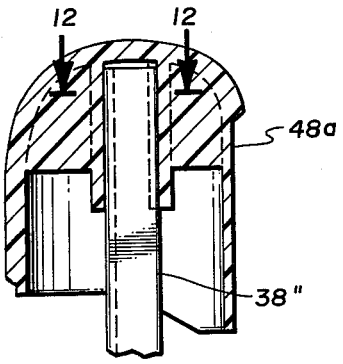
FIG. 11 is a right side elevation of the head of the toy athlete shown in FIG. 9 with the parts broken away.
Figure 12:
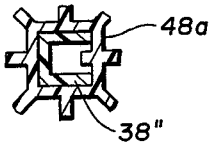
FIG. 12 is a section view of the head taken along line 12—12 of FIG. 11.

The plunger 38'' has a channel-shaped cross section rather than the I-shaped cross section shown in connection with the football player described previously. As those skilled in the art with recognize, either a channel- or I-shaped cross section can be used in all embodiments of the invention, although one may be preferred over the other in certain instances. The keying arrangement used for the head **48*a* is somewhat different than that used for an athlete that has a helmet, such as a toy football player. FIGS. 11 and 12 show the keying arrangement used for an athlete that does not include a helmet and for a plunger having a channel-shaped cross section. The principles of that keying arrangement are the same as those shown in FIGS. 5, 6 and 7 and are not described here. Those skilled in the art understand that a head-helmet configuration or a head-only configuration can be used interchangeablywith a plunger having either an I-shaped or a channel-shaped cross section, and will be able to practice that interchangeability from an examination of FIGS. 5, 6, 7, 11, and 12**.

The athlete shown in FIG. 9 has an additional feature that adds realism to the toy. The arm 210 can be moved to various positions independently of the movement of the arm 78″. The arm 210 includes an axle 252 that has a segmented flange 254 secured thereto. The flange 254 captures the hollow body portion **14*a* between itself and a surface 256 of the arm 210 to form a frictional bearing that enables the arm 210** to be moved into any desired position.

The operation of the toy basketball player is similar to that of the toy football player previously described. The elastic band 248 biases the arm 78″ into its rest position (shown in solid lines in FIG. 10A) and forces the finger 238 against the tab 240. The plunger 38″ is held in its rest position (shown in solid lines in FIG. 10A) by the protrusion 236 which bears against the surface formed by the offset 214. The lever arm 78″ includes a hand 258 in which the toy basketball BB rests when the lever arm 78″ is in its rest position. A downward blow to the head **48*a* of the basketball player causes the plunger 38″ to move toward its extended position (shown in dotted lines in FIG. 10A) and the surface formed by the offset 214 moves the protrusion 236 downwardly. The lever arm 78″ thus quickly rotates toward its extended position and propels the toy basketball from the hand 258. Depending on the force of the downward blow, the lever arm 78″ may continue to rotate when the travel of the plunger 38″ is stopped by the projections 44*a* and 46*a*. However, the lever arm 78″ can rotate only until the finger 242 contacts the tab 244 at which point the lever arm 78″ is in its fully extended position. The arm 78″ and the plunger 38″ are returned back to their rest positions by the elastic band 248 when the downward force is removed from the plunger 38″. The offset 212 prevents the plunger 38″ from contacting the hub extension 230 when the plunger 38″** is in its extended position.

Figure 13A:
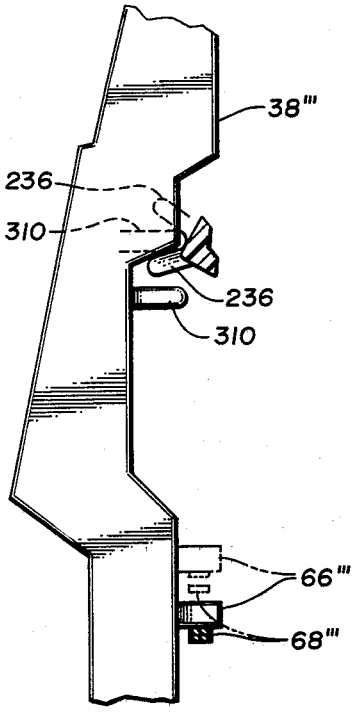
FIGS. 13A and 13B are side and front views, respectively, of the details of an alternate embodiment of the present invention in which the plunger and lever arm shown in FIG. 10A are modified.
Figure 13B:
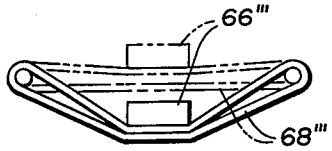

FIGS. 13A and 13B show another embodiment of the present invention in which the plunger 38″ and the lever arm 78″ described above are modified. The basic configuration of the plunger and lever arm is similar to that of plunger 38″ and lever arm 78″, but in this embodiment the spring means cooperates directly with the plunger rather than with the axle member.

In this embodiment, as seen in FIGS. 13A and 13B, a plunger 38‴ includes a tab 66‴ similar to the tab 66 shown in connection with the football player (see FIGS. 2 and 4). An elastic band 68‴ cooperates with the tab 66‴ in a manner similar to that in which the elastic band 68 cooperates with the tab 66 of the football player. In this embodiment, the plunger 38‴ includes a tab 310 for cooperating with the protrusion 236 on the hub extension 230 of the axle member of the lever arm. The protrusion 246 on the hub extension 230 and the anchor point 250 on the back body piece are omitted.

The operation of the embodiment shown in FIGS. 13A and 13B is identical to the operation of the basketball player embodiment. However, the spring means biases the plunger into its rest position (shown in dotted lines in FIGS. 13A and 13B) directly, rather than acting through the axle member. The axle member, and therefore the lever arm, are biased into their rest position by the tab 310 on the plunger 38‴.

Figure 14:
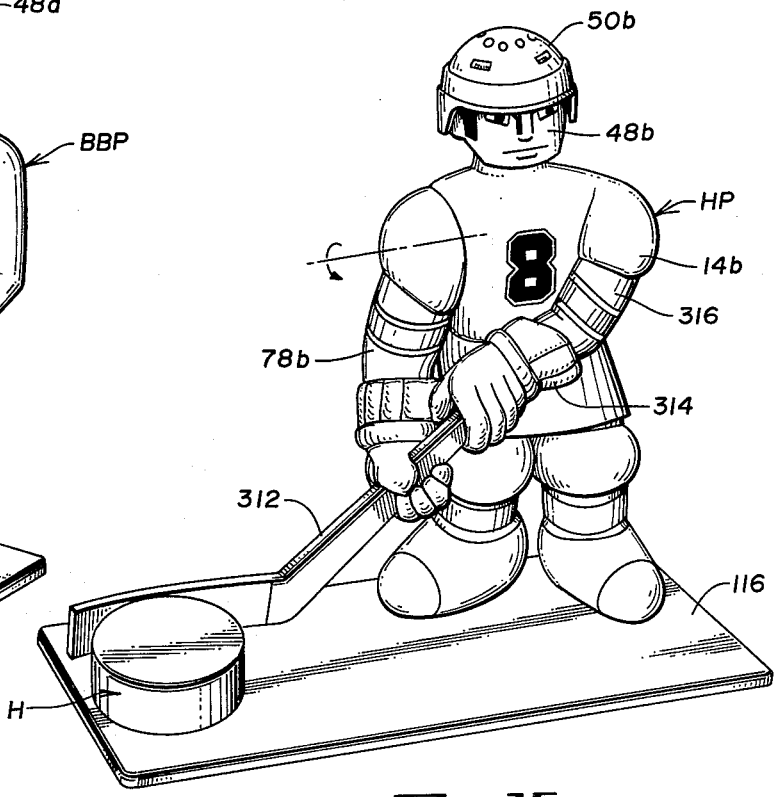
FIG. 14 is a pictorial drawing of a mechanical toy athlete showing the embodiment of the present invention in which the toy athlete represents a soccer player.

FIG. 14 is a pictorial drawing of a mechanical toy athlete HP showing the embodiment of the present invention in which the athlete represents a hockey player executing a slap shot. The toy hockey player has a hollow body portion **14*b* that is shaped to resemble the padded torso of a real hockey player and carries markings resembling those on a real hocky player's uniform. The lever arm of this embodiment of the present invention comprises an arm 78*b* of the hockey player to which is secured a hockey stick 312. The lever arm 78*b* sweeps the ground as it moves from its rest position to its extended position and propels a toy projectile H resembling a hockey puck. The striker comprises a head 48*b* and a helmet 50*b* that carry suitable markings to increase realism. The gloved hand 314 of the other arm 316 is secured to the hockey stick 312. The arm 316 is molded into the hollow body portion 14*b*. Those skilled in the art will recognize that any one of the embodiments of the plunger and lever arm mechanisms described above may be used with the hockey player shown in FIG. 14**.

Figure 15:
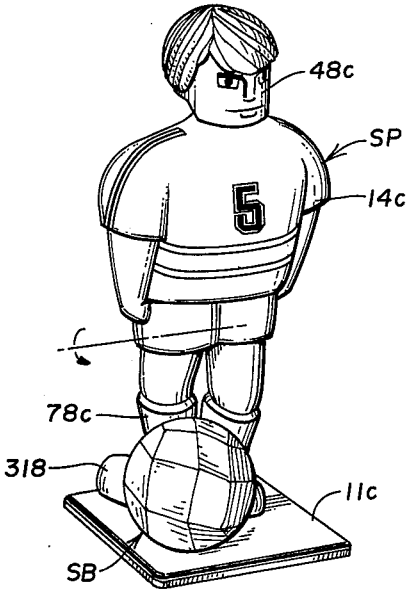
FIG. 15 is a pictorial drawing of a mechanical toy athlete showing the embodiment of the present invention in which the toy athlete represents a hockey player.

FIG. 15 is a pictorial drawing of a mechanical toy athlete SP showing the embodiment of the present invention in which the athlete represents a soccer player. The toy soccer player has a hollow body portion **14*c* that is shaped to resemble the torso of a real soccer player and carries markings resembling those on a real soccer player's uniform. The lever arm of this embodiment of the present invention comprises a leg 78*c* of the soccer player. The leg 78*c* has a foot 318 at its bottom end that is turned at a right angle to the direction of travel of the leg so that as the leg moves from its rest position toward its extended position, a toy projectile SB resembling a soccer ball is struck by the instep of the foot. The projectile SB has myriad flat surfaces, sufficient to make it resemble a true sphere, that prevent is from rolling when it is placed on the base 11*c* in position to be propelled. The striker for this embodiment comprises a head 48*c*** that is suitably formed and marked to increase realism. Again, the configuration of the plunger and lever arm mechanism is a matter of choice to those skilled in the art.

Those skilled in the art will immediately recognize that the mechanical toy of the present invention can assume embodiments other than those specifically disclosed herein without departing from the spirit of the invention. For example, many kinds of athletes could be represented. Those skilled in the art will also recognize that various elements disclosed herein can assume alternate forms while remaining within the spirit of the invention. For example, the head of the figure could be attached to the end of the plunger by other means, such as screw threads, a pin, or glue; alternatively the head, helmet and the plunger could form one piece. Suitable orientation means can substitute for keying means shown above. Similarly, the plunger need not be constrained by projections extending into the hollow body portion; a guiding channel could be cut down into the hollow body portion.

Although several specific embodiments of the present invention have been shown, those skilled in the art will perceive further modifications other than those specifically pointed out above which can be made without departing from the spirit of the invention, and it is intended by the appended claims to cover all such modifications as fall within the true spirit and scope of the invention.

We claim:

1. A mechanical toy, which resembles a human figure, comprising:

a hollow body portion that includes bearing means, which hollow body portion comprises the torso of the human figure;

a lever arm that includes an axle member pivotally mounted in said bearing means to enable rotation of said lever arm from a rest position, into which said lever arm is biased, toward an extended position for propelling a toy projectile and back again, which lever arm resembles in appearance and movement a limb of the human figure;

a slidable plunger mounted in said hollow body portion to enable longitudinal movement of said slidable plunger from a rest position, into which said slidable plunger is biased, toward an extended position by application of an externally supplied force and back again, which slidable plunger cooperates with said lever arm to rotate said lever arm toward its extended position when said slidable plunger is moved toward its extended position;

a striker secured to the top of said slidable plunger; and keying means for orienting said striker relative to said slidable plunger, wherein said keying means includes:

a longitudinal channel in said top end of said slidable plunger;

a square opening in said striker for accepting said slidable plunger, which striker includes a keying flange extending into said square opening for cooperation with said longitudinal channel.

2. The mechanical toy recited in claim 1 wherein said slidable plunger has a channel-shaped cross section that forms said longitudinal channel.

3. The mechanical toy recited in claim 1 wherein said slidable plunger has an I-shaped cross section that forms said longitudinal channel, said I-shaped cross section including a filler flange for a predetermined length at the top end of said slidable plunger.

4. The mechanical toy recited in claim 1 wherein:

said striker resembles a bare head of the human figure having markings resembling the face of the human figure;

said square opening is in the center of and inside said bare head and is small enough to frictionally engage said slidable plunger when it accepts said slidable plunger; and said keying means orients said markings to the front of the human figure.

5. The mechanical toy recited in claim 1 wherein:

said striker resembles a head having markings resembling the face of the human figure and is covered by a helmet that resembles the protective head gear of a human athlete;

said head and said helmet are separate pieces;

said square opening extends through said head and into said helmet, in which helmet said square opening is blind and is small enough to frictionally engage said slidable plunger when it accepts said slidable plunger;

said slidable plunger has a stop means that cooperates with said head to limit the extent to which said slidable plunger extends through said square opening in said head;

said head is captured between said helmet and said stop means; and said keying means orients said markings to the front of the figure and said helmet relative to said markings.

6. A mechanical toy, which resembles a human figure, comprising:

a hollow body portion that includes bearing means and two fastening points, which hollow body portion comprises the torso of the human figure;

a lever arm that includes an axle member pivotally mounted in said bearing means to enable rotation of said lever arm from a rest position, into which said lever arm is biased, toward an extended position for propelling a toy projectile and back again, which lever arm resembles in appearance and movement a limb of the human figure;

a slidable plunger mounted in said hollow body portion to enable longitudinal movement of said slidable plunger from a rest position, into which said slidable plunger is biased, toward an extended position by application of an externally supplied force and back again, which slidable plunger cooperates with said lever arm to rotate said lever arm toward its extended position when said slidable plunger is moved toward its extended position;

an elastic band stretched around said fastening points and dispersed within and attached to said hollow body portion for cooperation with said slidable plunger to bias said slidable plunger toward its rest position; and said slidable plunger includes an engaging means for cooperating with said elastic band at a point substantially equidistant from said fastening points.

7. A mechanical toy, which resembles a human figure, comprising:

a hollow body portion that includes bearing means, which hollow body portion comprises the torso of the human figure;

a lever arm that includes a radially extending finger and an axle member pivotally mounted in said bearing means to enable rotation of said lever arm from a rest position, into which said lever arm is biased, toward an extended position for propelling a toy projectile and back again, which lever arm resembles in appearance and movement a limb of the human figure;

a slidable plunger mounted in said hollow body portion to enable longitudinal movement of said slidable plunger from a rest position, into which said slidable plunger is biased, toward an extended position by application of an externally supplied force and back again, which slidable plunger cooperates with said lever arm to rotate said lever arm toward its extended position when said slidable plunger is moved toward its extended position; and said plunger includes actuation means for cooperating with said finger to rotate said lever arm toward its extended position when said plunger is moved toward its extended position.

8. The mechanical toy recited in claim 7 wherein said actuation means comprises an offset in said slidable plunger, which offset presents a surface for cooperating with said finger.

9. The mechanical toy recited in claim 8 wherein:

said axle member includes a rest position limiting finger; and said hollow body portion includes a rest position limiting tab for cooperating with said rest position limiting finger to limit movement of said lever arm and define said rest position of said lever.

10. The mechanical toy recited in claim 9 wherein:

said axle member includes an extended position limiting finger; and said hollow body portion includes an extended position limiting tab for cooperating with said extended position limiting finger to limit movement of said lever arm and define said extended position of said lever arm.

11. The mechanical toy recited in claim 10 wherein:

said plunger includes at least one extended position limiting shoulder;

said hollow body portion includes at least one extended position limiting projection for cooperating with said extended position limiting shoulder to limit movement of said slidable plunger and define said extended position of said slidable plunger; and said slidable plunger reaches its extended position before said lever arm reaches its extended position.

12. A mechanical toy, which resembles a human basketball player, comprising:

a hollow body portion that includes bearing means, which hollow body portion comprises the torso of a basketball player and carries markings resembling the uniform of a basketball player;

a lever arm that includes an axle member pivotally mounted in said bearing means to enable rotation of said lever arm from a rest position, into which said lever arm is biased, toward an extended position for propelling a toy projectile and back again, which lever arm resembles in appearance and movement the arm of the basketball player and in its rest position is above the head of the basketball player and includes a hand in which a toy basketball rests to be propelled when said lever arm moves toward its extended position;

a slidable plunger mounted in said hollow body portion to enable longitudinal movement of said slidable plunger from a rest position, into which said slidable plunger is biased, toward an extended position by application of an externally supplied force and back again, which slidable plunger cooperates with said lever arm to rotate said lever arm toward its extended position when said slidable plunger is moved toward its extended position.

13. A mechanical toy, which resembles a human hockey player executing a shot, comprising:

a hollow body portion that includes bearing means, which hollow body portion resembles the padded torso of the hockey player and carries markings resembling the uniform of a hockey player;

a lever arm that includes an axle member pivotally mounted in said bearing means to enable rotation of said lever arm from a rest position, into which said lever arm is biased, toward an extended position for propelling a toy projectile and back again, which lever arm resembles in appearance and movement an arm of the hockey player and includes a hockey stick secured to the arm of the hockey player to resemble a hockey player holding said hockey stick which sweeps the ground when said lever arm moves toward its extended position to strike a toy hockey puck; and a slidable plunger mounted in said hollow body portion to enable longitudinal movement of said slidable plunger from a rest position, into which said slidable plunger is biased, toward an extended position by application of an externally supplied force and back again, which slidable plunger cooperates with said lever arm to rotate said lever arm toward its extended position when said slidable plunger is moved toward its extended position.

14. A mechanical toy, which resembles a human figure, which is to be subjected to an external striking force having a body portion;

a lever arm pivotally mounted in the body portion to enable rotation of the lever arm from a rest position toward an extended position and back again; and a plunger slidably mounted in the body portion to enable longitudinal movement of the slidable plunger from a rest position toward an extended position by application of the externally supplied striking force and back again, which plunger is cooperatively positioned relative to the lever arm to rotate the lever arm toward its extended position;

characterized in that the body portion is formed of a plurality of shell portions secured together to form a hollow body cavity, each shell portion having a substantially uniform thickness throughout and a plurality of cooperating projecting structural elements integrally formed with the shell portion extending into the hollow body cavity to cross-support the body portion and to contain and guide the slidable plunger and lever arm whereby the external striking force is translated into an extension of the lever arm without destruction of the toy.

15. The mechanical toy recited in claim 14 wherein:

said body portion includes an anchor point;

said lever arm includes an axle member;

said axle member includes a radially extending protrusion; and said elastic band is stretched between said anchor point and said radially extending protrusion.

16. The mechanical toy recited in claim 14 wherein:

said lever arm includes a cam surface; and said plunger terminates in a bottom end within said hollow body cavity, which bottom end of said plunger cooperates with said cam surface to rotate said lever arm toward its extended position when said plunger is moved toward its extended position.

17. The mechanical toy recited in claim 14 wherein:

the human figure is that of a football player;

said body portion resembles the padded torso of a football player and carries markings resembling the uniform of a football player; and said lever arm includes a foot for striking a toy football when said lever arm moves toward its extended position.

18. The mechanical toy recited in claim 14 wherein:

the human figure is that of a soccer player;

said body portion resembles the torso of a soccer player and carries markings resembling the uniform of a soccer player; and said lever arm includes a foot turned at a right angle to the direction of travel of said lever arm so that movement of said lever arm toward its extended position causes the foot to strike a toy soccer ball on the instep of said foot.

19. The mechanical toy of claim 14 further characterized in that the lever arm is pivotally mounted in the body portion on an axle and wherein the plurality of cooperating projecting structural elements comprise means for containing the axle within the body portion to form a bearing means whereby the lever arm pivots to its extended position and back to its rest position on the bearing means.

20. The mechanical toy of claim 14 further characterized in that the plurality of cooperating projection structural elements comprise means for retaining and containing an elastic band to bias both the lever arm and the plunger to their rest positions.

21. The mechanical toy of claim 14 further characterized in that the plurality of cooperating projecting structural elements further comprise alignment means operatively associated with the lever arm to return the lever arm to its rest position properly aligned with the body portion.

* * * * *